US005921690A

United States Patent [19]

Shinmachi et al.

[11] Patent Number: 5,921,690

[45] Date of Patent: Jul. 13, 1999

[54] DISCHARGED-SHEET STACKING DEVICE, AND IMAGE FORMING APPARATUS INCLUDING THE SAME

[75] Inventors: Masaya Shinmachi, Kawasaki; Masahito Yoshida, Shiki, both of Japan

[73] Assignee: Canon Kabushiki Kaisha, Tokyo, Japan

[21] Appl. No.: 09/055,882

[22] Filed: Apr. 7, 1998

[30] Foreign Application Priority Data

Apr. 17, 1997 [JP] Japan ..... 9-100629
Mar. 16, 1998 [JP] Japan ..... 10-065288

[51] Int. Cl.[6] ..... B41J 13/10

[52] U.S. Cl. ..... 400/625; 271/213; 347/102

[58] Field of Search ..... 400/624, 625, 400/629; 347/102, 104; 271/213, 214, 217, 218, 287, 279, 292, 293

[56] References Cited

U.S. PATENT DOCUMENTS

| | | | |
|---|---|---|---|
| 4,433,837 | 2/1984 | Romanowski | 271/292 |
| 4,460,169 | 7/1984 | Bartesaghi | 271/217 |
| 4,512,565 | 4/1985 | Matsumoto et al. | 271/293 |
| 4,577,852 | 3/1986 | Grunder | 271/213 |
| 4,616,821 | 10/1986 | Boeve et al. | 271/213 |
| 4,794,859 | 1/1989 | Huseby et al. | 271/213 |
| 4,844,633 | 7/1989 | Greenberg | 400/625 |
| 5,226,743 | 7/1993 | Jackson et al. | 400/625 |
| 5,536,000 | 7/1996 | Kelly | 271/213 |
| 5,547,182 | 8/1996 | Murphy et al. | 347/102 |
| 5,725,319 | 3/1998 | Saito et al. | 400/629 |
| 5,767,884 | 6/1998 | Bortolotti et al. | 347/102 |
| 5,769,413 | 6/1998 | Hummel et al. | 271/213 |

*Primary Examiner*—Christopher A. Bennett
*Attorney, Agent, or Firm*—Fitzpatrick, Cella, Harper & Scinto

[57] ABSTRACT

An image forming apparatus has a discharged-sheet stacker in which a longer time period can be secured until sheets are superposed. A plurality of stages of discharged-sheet supports, each for holding a sheet, are provided in the discharged-sheet stacker. By sequentially operating the discharged-sheet supports, a printed sheet is sequentially shifted between the discharged-sheet supports, and is finally mounted onto a discharged-sheet tray. By operating the discharged-sheet supports even after printing has been completed, all printed sheets are finally mounted on the discharged-sheet tray.

5 Claims, 6 Drawing Sheets

DISCHARGED-SHEET STACKING DEVICE, AND IMAGE FORMING APPARATUS INCLUDING THE SAME

BACKGROUND OF THE INVENTION

1. Field of the Invention

The present invention relates to a discharged-sheet stacking device of an image forming apparatus, and more particularly, to a discharged-sheet stacking evice of an image forming apparatus using ink.

2. Description of the Related Art

Ink-jet printers perform printing by discharging an ink liquid onto a recording sheet. Hence, if the printed surface of the sheet touches another object before the discharged ink liquid is fixed by drying, the printed surface will be stained. In order to solve such a problem, some ink-jet printers incorporate a heater for rapidly drying the ink. Other ink-jet printers include a discharged-sheet stacking device for preventing, while executing continuous printing, a sheet from being superposed on and staining a previously printed sheet on which the ink is not yet dried.

FIG. 6 is a perspective view of a conventional ink-jet printer including a discharged-sheet stacking device. FIG. 7 is a perspective view of the discharged-sheet stacking device of the ink-jet printer of FIG. 5.

A sheet P is conveyed by an internal sheet conveying mechanism (not shown) after a printing operation, and is discharged from a sheet discharging port 2. Openable/closable movable supporting members 30 for temporarily holding sheets after printing are provided in front and at both sides of sheet discharging port 2. The supporting members 30 are operated by a cam mechanism (not shown) or the like. A discharged-sheet tray 34 where sheets after printing are finally mounted is provided under the supporting members 30.

The sheet P, after printing, is first discharged along the supporting members 30. The sheet P is held by the supporting members 30 for a predetermined drying time period. Accordingly, the sheet P is not placed on top of the immediately previously printed sheet P1 or allowed to rub against it. The drying time period is the time required for ink on the sheet P1 mounted on the discharged-sheet tray 34 to dry.

After the lapse of the drying time period, the interval between the supporting members 30 is made wider than the width of the sheet by operating the cam mechanism, and the sheet P drops onto the sheet P1.

In an ink-jet printer including such a stacking device, the time period until sheets are placed on top of one another can be secured while printing is performed on each sheet. Accordingly, it is possible to provide ink with a time period for drying, and to prevent sheets from being stained due to superposition and rubbing.

In recent ink-jet printers, however, printing speeds have increased, so that a time period which can be utilized for drying ink is reduced. Furthermore, since various types of recording materials are being developed, some recording materials require a longer time period for drying ink than ordinary recording materials. Hence, in conventional discharged-sheet stacking devices, there is the possibility that a sufficient drying time period cannot be secured, thereby producing ink stains due to superposition and rubbing of sheets. In order to overcome such problems, it is necessary to dry ink by providing a waiting time period during printing or sheet discharging. Hence, an ink drying process is an obstacle for an increase in the printing speed of ink-jet printers.

SUMMARY OF THE INVENTION

It is an object of the present invention to provide a discharged-sheet stacking device which can be used in a high-speed printer, and an image forming apparatus including such a device.

In accordance with these objects, there is provided a discharged-sheet stacking device for stacking sheets discharged from another device, the discharged-sheet stacking device having a plurality of holding units, each with supports movable between a closed holding position where a discharged sheet is held, and an open releasing position where a held sheet is released, the holding units disposed vertically to one another, a holding-unit driving means for independently moving each of the holding units between the closed holding position and the open releasing position anda stacking control means for controlling movement of the holding units by the holding-unit driving means, to sequentially reposition sheets held in a first one of the plurality of units to drop into a second one of the plurality of units which is lower than the first holding unit by moving the position of the first holding unit in a predetermined sequence.

According to another aspect, the present invention which achieves the above-described object relates to an image forming apparatus including the above-described discharged-sheet stacking device, image forming means for forming an image on a sheet, discharging means for discharging the sheet on which the image has been formed by the image forming apparatus toward the discharged-sheet stacking device, and main control means for controlling the discharged-sheet stacking device and the image forming means. The main control means causes the stacking control means to continue the repositioning while a sheet is held in any one of the holding units even after the image formation by the image forming means has been completed.

The main control means may determine whether or not a sheet is still held in any one of the holding units, based on a number of sheets on which images have been formed by the image forming means, and a frequency of execution of the rearranging processing.

The image forming means may form an image by discharging ink onto a sheet.

According to still another aspect, the present invention which achieves the above-described objects relates to a discharged-sheet stacking device including a plurality of stages of holding units each of which is configured to assume at least two different states, i.e., a holding state where a discharged sheet is held and a releasing state where holding of a sheet is released, and in which sheets held in the holding state are disposed so as to be vertically superposed, holding-unit driving means for shifting a state of the holding unit between the holding state and the releasing state, discharging means for discharging a sheet onto the uppermost holding unit from among the plurality of stages of holding units, and control means for controlling the holding-unit driving means so that every time a sheet is discharged by the discharging means, the holding units are sequentially shifted to the holding release state and are then returned to the holding state from the lowermost stage to the uppermost stage.

The foregoing and other objects, advantages and features of the present invention will become more apparent from the following detailed description of the preferred embodiment taken in conjunction with the accompanying drawings.

DETAILED DESCRIPTION OF THE PREFERRED EMBODIMENT

An ink-jet printer according to an embodiment of the present invention has a plurality of stages of stacks (discharged-sheet supports), each for temporarily holdng a sheet after printing. The detail of the printer will now be described.

Figure 2:
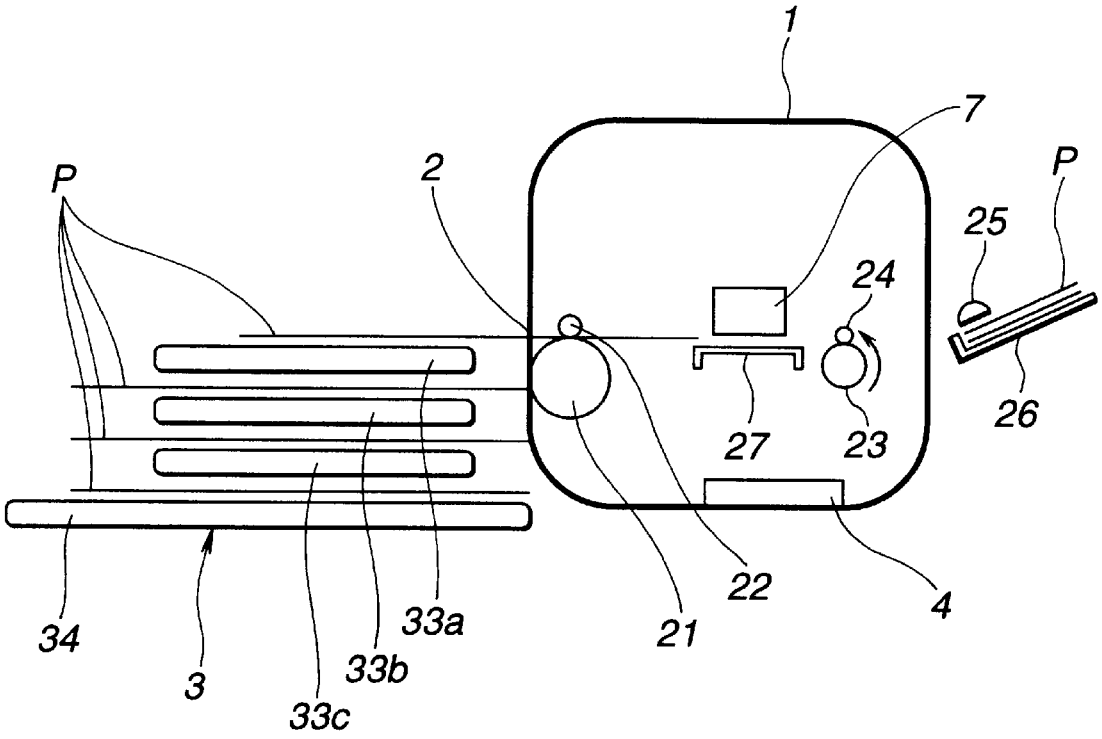
FIG. 2 is a schematic side view illustrating the configuration of a discharged-sheet stacking unit.

As shown in FIG. 2, the printer of this embodiment incorporates in a main body 1 a conveying mechanism for conveying a sheet, a head 7 for forming an image by discharging ink onto the sheet, a driving mechanism for the head 7, a control device 4, and the like.

Figure 1:
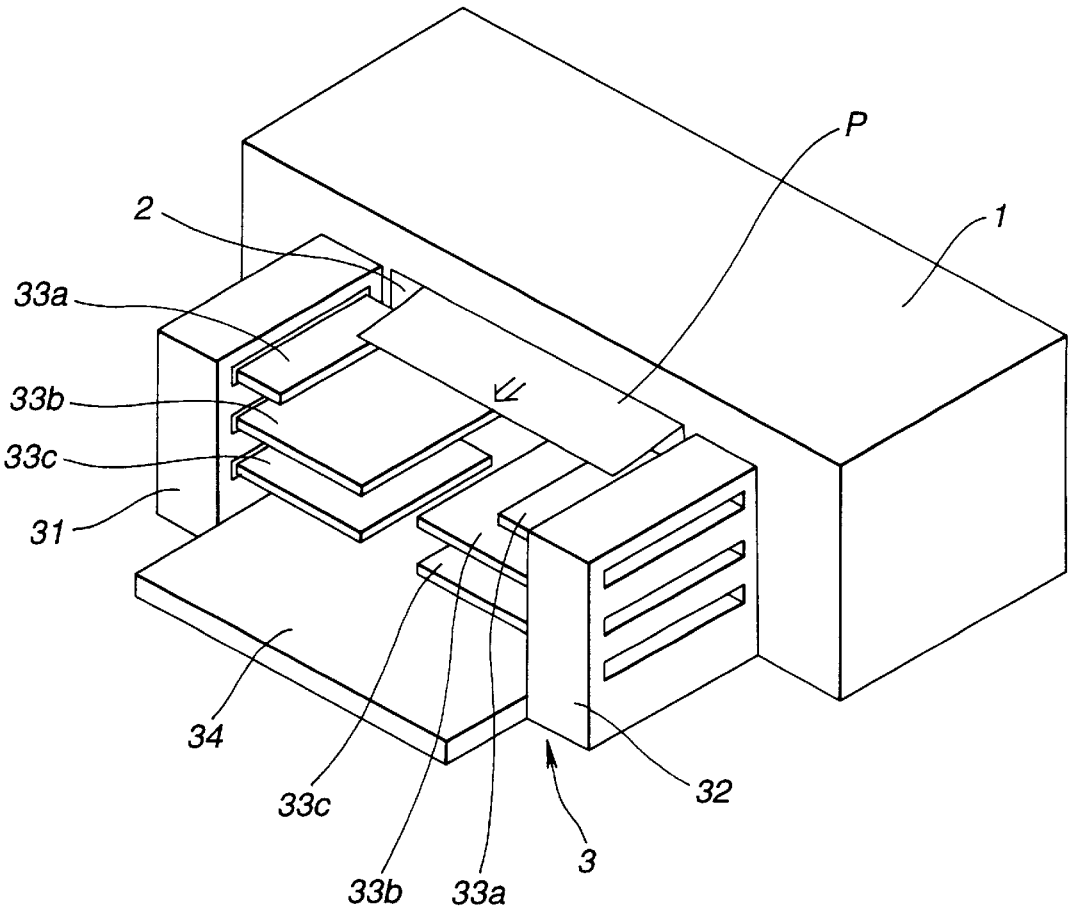
FIG. 1 is a perspective view of a printer according to an embodiment of the present invention.

As shown in FIG. 1, a discharging port 2 for discharging a sheet having an image formed thereon is provided at the front side of the main body 1. A sheet discharging spur 22 and a sheet discharging roller 21 are provided adjacent the discharging port 2 within the main body 1. The sheet discharging roller 21 is driven by a conveyance driving motor 5 under the control of the control device 4 (see FIG. 3).

A discharged-sheet stacking unit 3 for holding discharged sheets is provided outside the discharging port 2.

The discharged-sheet stacking unit 3 includes right and left pairs of discharged-sheet supports 33*a*, 33*b* and 33*c* for holding sheets, a discharged-sheet tray 34 for mounting the sheets, support guides 31 and 32 for guiding the discharged-sheet support pairs 33*a*, 33*b* and 33*c*, and the like. The discharged-sheet support pairs 33*a*, 33*b* and 33*c* are hereinafter jointly termed "discharged-sheet supports 33".

The discharged sheet supports 33 temporarily hold sheets discharged from the discharging port 2. In this embodiment, the discharged-sheet supports 33 are provided in three stages (33*a*, 33*b* and 33*c*). The discharged-sheet support pairs 33*a*, 33*b* and 33*c* are supported by the support guides 31 and 32, and are configured so as to be movable independently to the right and left of the supporting port 2 (in directions of the width of a sheet discharged from the discharging port 2). The discharged-sheet supports 33*a*, 33*b* and 33*c* are vertically superposed. Accordingly, when the gap interval between one pair of the right and left discharged-sheet supports 33 is narrowed, the pair are closed and a sheet is held by the pair of discharged-sheet supports 33. On the other hand, by moving the right and left discharged supports 33 so as to increase the gap therebetween (parallel movement to the right and left), the pair are open and the held sheet drops due to gravity and falls on discharged-sheet supports positioned below the above-mentioned discharged-sheet supports (or on the discharged-sheet tray 34).

Figure 3:
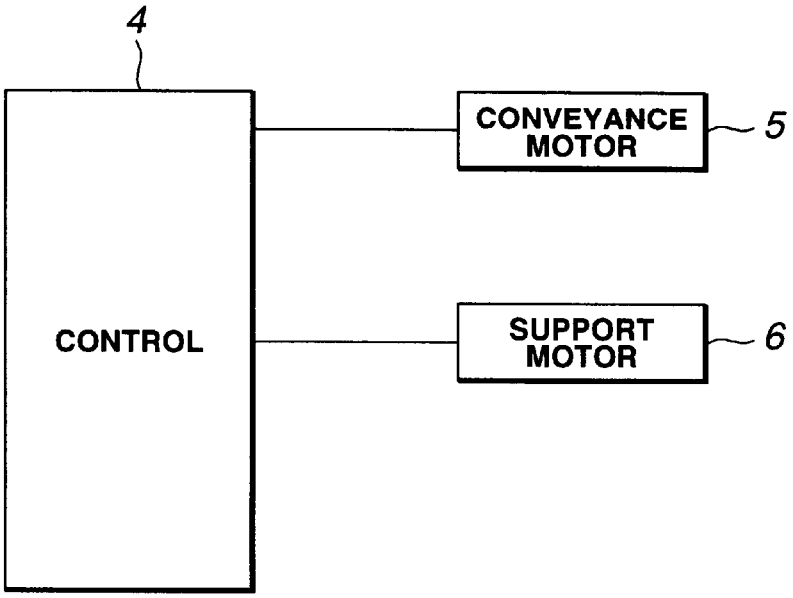
FIG. 3 is a diagram illustrating the configuration of control for the discharged-sheet stacking unit.

Next, the configuration of the control for the discharged-sheet stacking unit 3 will be described with reference to FIG. 3.

The conveyance driving motor 5 drives the discharged-sheet roller 21. A support driving motor 6 drives the discharged-sheet support pairs 33. The driving force of the support driving motor 6 is transmitted by a predetermined transmission mechanism (not shown) so as to independently operate the discharged-sheet support pairs 33*a*, 33*b* and 33*c*.

The control device 4 controls the entire printer main body. The control device 4 has, for example, the function of operating the discharged-sheet support pairs 33 and the like at predetermined timings by controlling the driving of the conveyance driving motor 5, the support driving motor 6. The control device 4 also has the function of counting the frequency of execution of processing to be described later (see FIGS. 4 (*a*) through 4(*e*)) by the discharged-sheet stacking unit 3. More specifically, the control device 4 includes a ROM (read-only memory) storing control programs and the like, a RAM (random access memory) for holding printing data, a processor for executing control programs, and the like. Various kinds of data necessary for controls to be described later, such as data providing timings for operating the discharged-sheet support pairs 33, are stored in the ROM.

The "holding units" in the present invention are realized by the discharged-sheet support pairs 33 and the support guides 31 and 32. The "holding state" or closed position corresponds to a state in which the gap between the right and left discharged-sheet supports 33 is narrowed (for example, the state of the discharged-sheet supports 33*b* shown in FIG. 4(*a*)). The "holding releasing state" or open position corresponds to a state in which the gap between the right and left discharged-sheet supports 33 is widended (for example, the state of the discharged-sheet support pairs 33*c* shown in FIG. 4(*b*), or the state of the discharged-sheet support pairs 33*a* shown in FIG. 4(*d*)). The "holding-unit driving means" is realized by the support driving motor 6 and the like. The control device 4 includes programming in ROM for controlling both the support driving motor 6 and the conveyance motor 5. Of course, separate control devices may be provided for each motor. Thus, "stacking control means" corresponds to the control device 4. The "rearranging processing" corresponds to a series of processing which will be desribed later with reference to FIGS. 4(*a*) through 4(*e*). The "image forming means" corresponds to the head 7 and the like. The "discharging means" corresponds to the sheet discharging roller 21, the sheet discharging spur 22 and the like. The "main control means" corresponds to the control device 4 in this embodiment.

Next, the operation of the discharged-sheet stacking unit 3 will be described with reference to FIGS. 4(*a*) through 4(*e*).

Figure 4:
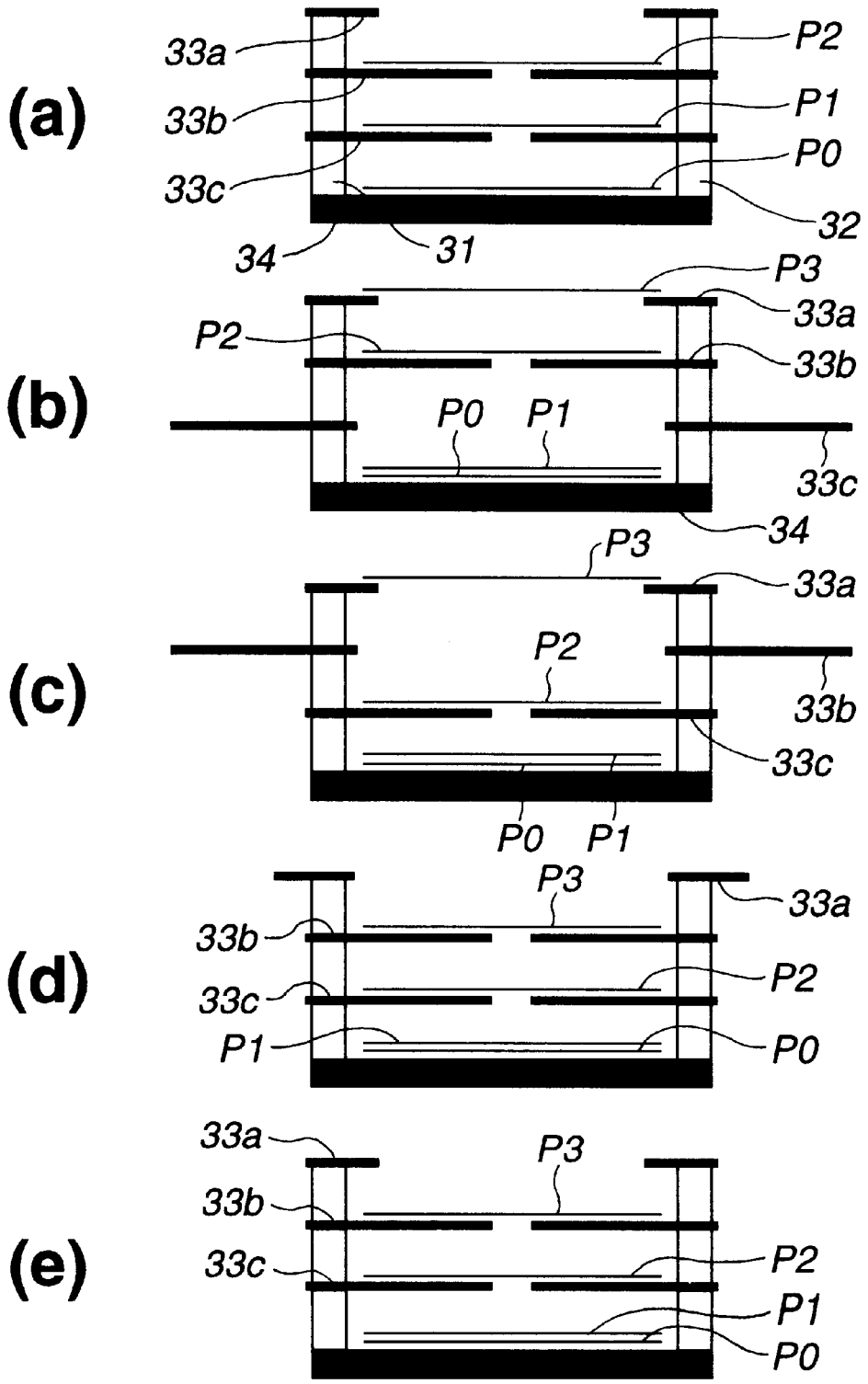
FIGS. 4(*a*) through 4(*e*) are diagrams illustrating operational states of a discharged-sheet stacking device as seen from the front side.

It it assumed that the process is in the midst of continuous printing, and that previously printed sheets P0, P1 and P2 are already mounted and held on the discharged-sheet tray 34, and the discharged-sheet support pairs 33*c* and 33*b*, respectively (see FIG. 4(*a*)).

A sheet P3 having an image formed thereon by the head 7, and conveyed by the conveying means (not shown) in the main body 1 is discharged from the sheet discharging port 2 onto the discharged-sheet stacking unit 3 by the sheet discharging roller 21 and the sheet discharging spur 22.

At that time, before the trailing edge of the sheet P3 leaves the sheet discharging roller 21, the discharged-sheet support pair 33*c* are first opened. As a result, the sheet P1 drops onto the discharged-sheet tray 34 (see FIG. 4(*b*)). Then, the discharged-sheet support pair 33 *c* are closed.

Printing is performed on the three sheets P1 through P3 during a time period from the end of printing on the sheet P0 present on the discharged-sheet tray 34 until the sheet P1 is mounted onto the sheet P0, and the time period required for printing on the three sheets is secured for drying ink on the sheet P0. The same holds for the sheets after the sheet P0, so that a time period from the end of printing on a preceding sheet until printing is performed on succeeding three sheets is secured for drying ink on the preceding sheet.

Then, the discharged-sheet support pair 33*b* are opened. As a result, the sheet P2 drops onto the discharged-sheet tray 33*c* (see FIG. 4(*c*=1)). Then, the discharged-sheet support pair 33*b* are closed.

The sheet P3 is discharged and held on the discharged-sheet support pair 33*a* during this time period. Then, the discharged-sheet support pair 33*a* are opened to drop the sheet P3 onto the discharged-sheet support pair 33*b* (see FIG. 4(*d*)). The discharged-sheet support pair 33*a* are thereafter closed, and the next sheet can be discharged (see FIG. 4(*e*)).

After the end of continuous printing, also, the discharged-sheet supports 33 are operated in the same sequence. Thus, sheets which have still been held on the discharged-sheet supports 33 at the end of printing are sequentially placed onto discharged-sheet supports 33 lower than the concerned discharged-sheet supports 33 (or onto the discharged-sheet tray 34). Finally, all printed sheets are mounted on the discharged-sheet tray 34. Accordingly, it is only necessary to take out a bundle of printed sheets mounted on the discharged-sheet tray 34 at a time (it is unnecessary to take out each sheet mounted on the discharged-sheet supports 33). In this case, the frequency of a series of the above-described operations (shown in FIGS. 4(*a*) through 4(*e*)) performed onto the discharged-sheet supports 33 after completing printing equals the number of stages of the discharged-sheet supports (three times in this embodiment).

The above-described processing of rearranging sheets is performed at a time interval of a series of the above-described operations (shown in FIGS. 4(*a*) through 4(*e*)) in consideration of a time period for drying ink on each sheet, so that the same time period as that during printing is secured for drying ink.

Figure 5:
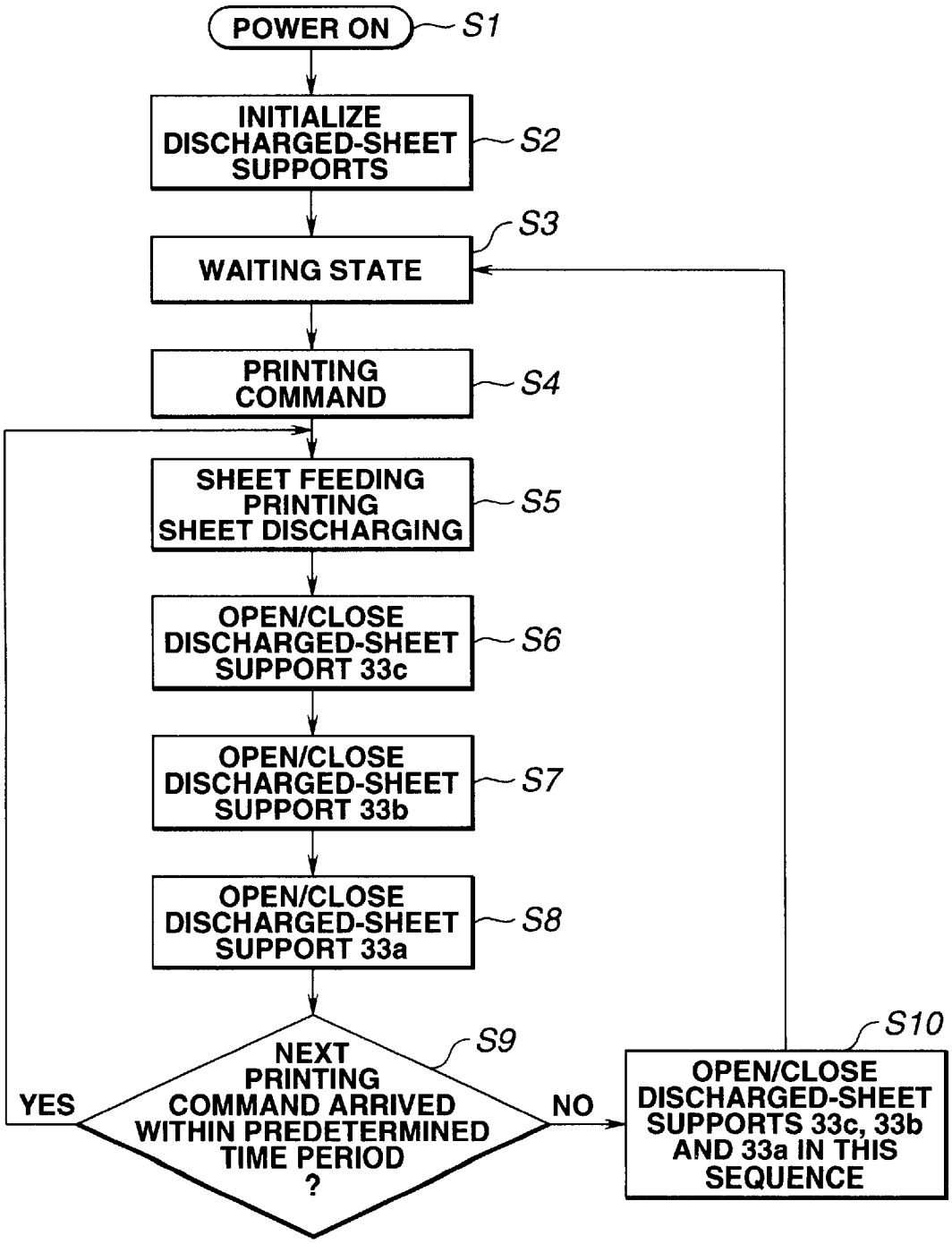
FIG. 5 is a flowchart illustrating the operation of the entire image forming apparatus (printer) controlled by control means.
Figure 6:
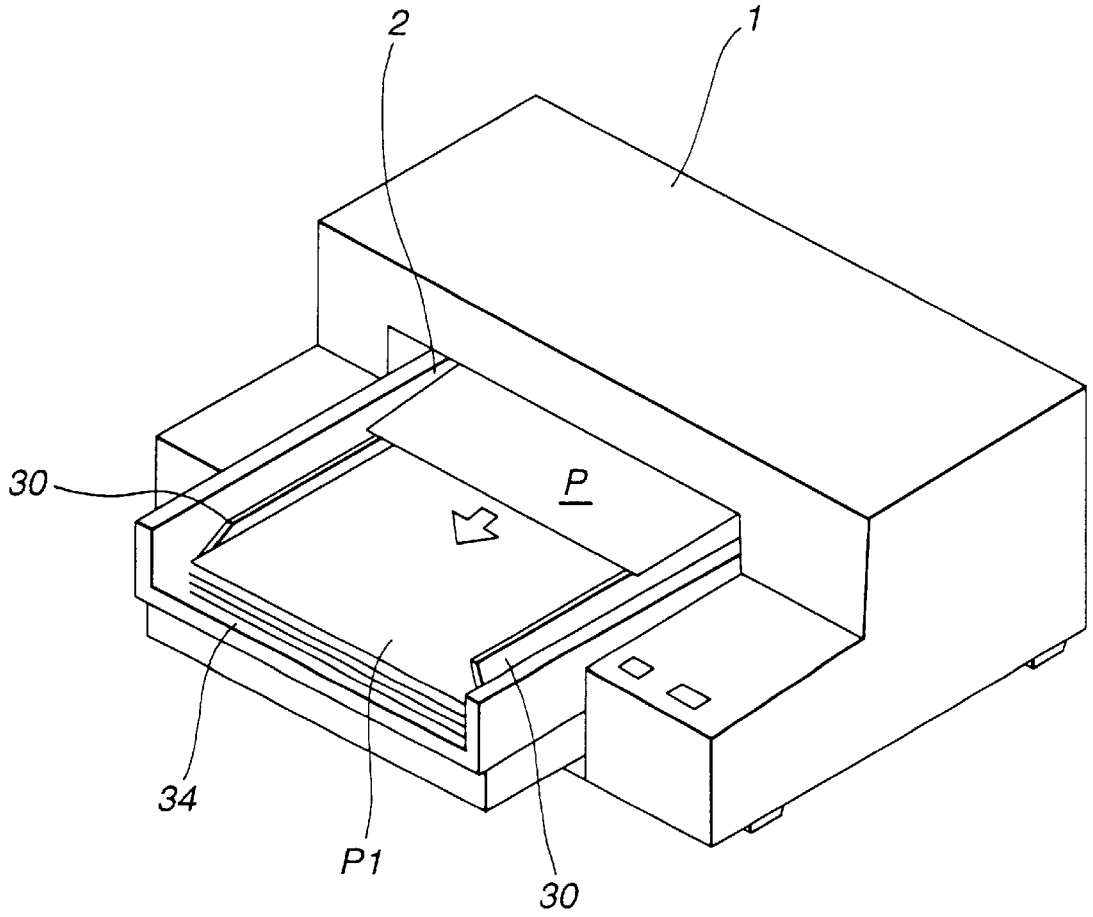
FIG.6 (PRIOR ART)
FIG. 6 is a perspective view of a printer including a conventional discharged-sheet stacking device.
Figure 7:
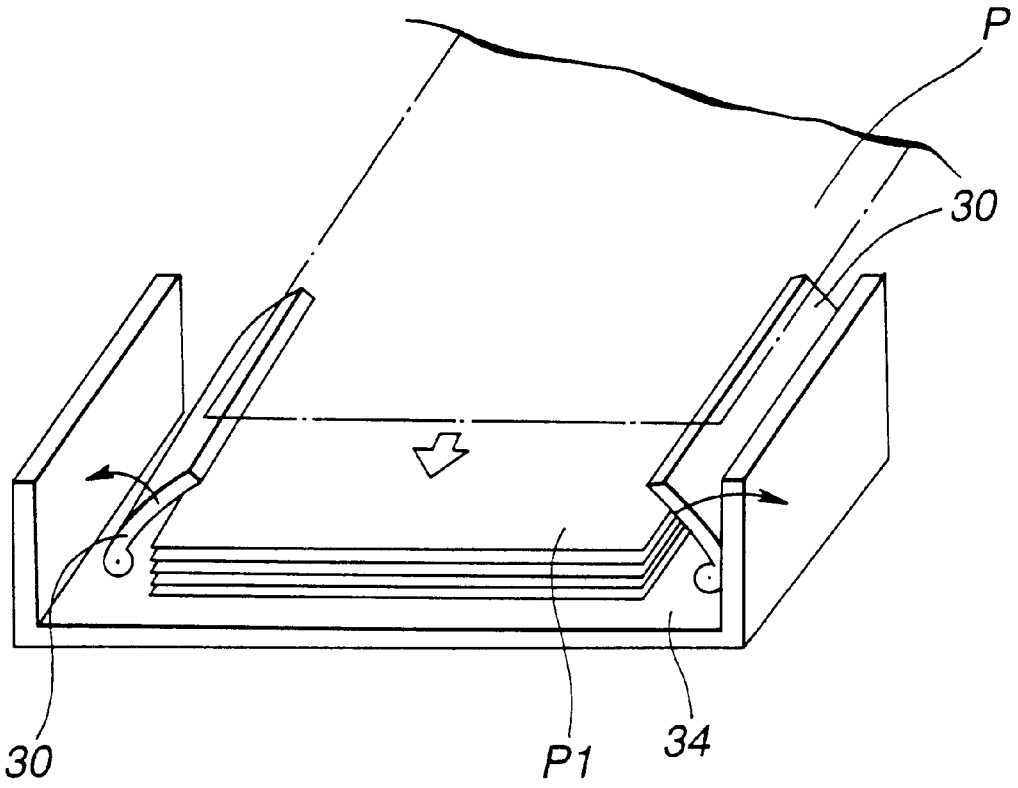
FIG.7 (PRIOR ART)
FIG. 7 is a perspective view of the conventional discharged-sheet stacking device.

Next, a description will be provided of the operation of the entire image forming apparatus (printer) controlled by a control unit which serves as main control means, with reference to the flowchart shown in FIG. 5.

First, when the power supply of the image forming apparatus has been turned on in step S1, processing of initializing the discharged-sheet supports is performed (step S2). In the initializing processing, no sheets are mounted on all of the discharged-sheet supports 33*a*, 33*b* and 33*c*, and at least the discharged-sheet support 33*a* is placed at a holding position in which a sheet can be held.

In an initializing operation, all the discharged-sheet supports 33*a*, 33*b* and 33*c* are simultaneously moved to the releasing position, and are then moved to respective discharged-sheet holding positions by simultaneously or sequentially moving them.

In another initializing operation, all the discharged-sheet supports 33*a*, 33*b* and 33*c* are sequentially moved to the holding releasing state starting from the uppermost support, and are then simultaneously moved to respective discharged-sheet holding positions.

When the power supply is turned off due to an abnormality, such as an error, interruption of electric power supply, or the like, there is the possibility that a sheet remains on a pair of discharged-sheet supports. If sheet discharging is performed immediately after the occurrence of an abnormality, the next sheet may be discharged superposed on the remaining sheet while still having undried ink thereon. The processing of initializing the discharged-sheet supports is performed for preventing such an occurrence.

The process then proceeds to step S3, where arrival of a printing command is awaited.

When a printing command has arrived (step S4), the process proceeds to step S5, where sheet feeding, printing, and sheet discharging are performed.

A pickup roller 25 shown in FIG. 2 rotates in a clockwise direction to pick up the uppermost sheet of sheets P mounted on a sheet feeding tray 26. The sheet P fed by the pickup roller 25 is conveyed to a platen 27 by being grasped between a conveying roller 23 rotatably driven in a counterclockwise direction, serving as conveying means, and a pinch roller 24 for pressing the sheet P against the conveying roller 23.

The sheet P is conveyed to a position to allow printing of the leading line by the recording head 7, and printing for one line (having a predetermined length in the conveying direction) is performed on the sheet P by the recording head 7. Thereafter, the sheet P is conveyed by the conveying roller 23 by the predetermined length corresponding to one line every time printing for one line has been completed, until recording for the final line is completed.

During a recording operation, the sheet discharging roller 21 and the sheet discharging spur 22 grasp the sheet P, and intermittently convey the sheet P in synchronization with the conveying roller 23. Upon completion of recording, the sheet P is discharged by the sheet discharging roller 21 and the sheet discharging spur 22.

Upon completion of a sheet discharging operation, the process proceeds to step S6, where the discharged-sheet supports 33*c* are opened to shift to the releasing position, and are then closed to move to holding positions. Then, the discharged-sheet supports 33*b* are moved to the releasing position, and are then closed to move to holding positions (step S7). Then, in step S8, the discharged-sheet supports 33*a* are shifted to the releasing position, and are then closed to move to holding positions.

In the embodiment, three stages of discharged-sheet supports are provided. In the case of discharged-sheet supports of four stages or more, also, processing of sequentially moving the discharged-sheet supports to the releasing position from the lowermost supports, and then closing the discharged-sheet supports to move to holding positions is performed up to the uppermost supports. Thus, sheets P mounted on discharged-sheet supports of respective stages are sequentially moved to lower supports, to provide a state in which no sheet is mounted on the uppermost discharged-sheet supports.

In step S9, it is determined if the next printing command has arrived within a predetermined time period after opening/closing the uppermost discharged-sheet supports. If the result of the determination in step S9 is affirmative, i.e., if the next page is present within a single job, or if the next jub starts immediately after a job has been completed, the process returns to step S5.

If the result of the determination in step S9 is negative, processing of sequentially shifting the discharged-sheet supports to the releasing position from the lowermost supports, and then closing the discharged-sheet supports to move to holding positions is performed up to the uppermost supports, to make the uppermost discharged-sheet supports 33*a* vacant.

As described above, in this embodiment, by providing three stages of discharged-sheet supports, a time period for performing printing on about three sheets can be secured for drying ink. It is thereby possible to prevent staining of a sheet caused by superposition and rubbing of sheets before the ink dries. It is also possible to deal with a further increase in the printing speed.

Although in the embodiment, three stages of discharged-sheet supports 33 are provided, the number of stages of discharged-sheet supports 33 is not limited to three. By further increasing the number of stages, it is possible to deal with a further increase in the printing speed and a case in which ink dries slowly.

Since sheets move by gravity between discharged-sheet supports 33 in a direction perpendicular to the printing surfaces of the sheets, rubbing between sheets can be minimized. Accordingly, the probability of a stain due to rubbing of sheets or the like is reduced.

After printing is complete, sheets remaining on the discharged-sheet supports 33 are finally moved onto the discharged-sheet tray 34. Accordingly, the operability when taking out printed sheets from the stacking unit 3 is excellent (it is unnecessary to take out each sheet).

The opening/closing mechanism of the discharged-sheet supports 33 is not limited to the above-described one (horizontal movement to the right and left). The discharged-sheet supports 33 may also be moved by using rotation or a linking mechanism. The specific configuration of the discharged-sheet supports 33 is not limited to the above-described one. For example, a plurality of narrow supporting plates or supporting bars may be provided.

Although in this embodiment, the discharged-sheet support pairs 33*a*, 33*b* and 33*c* can be independently operated, the operations of these supports need not be independently controlled. It is sufficient that these supports can be operated in a predetermined sequence by a mechanical device or the like.

In this embodiment, a timing of stopping the discharged-sheet supports 33 is determined by counting the frequency of operations of the discharged-sheet supports 33. However, a sensor for detecting whether or not each pair of discharged-sheet supports 33 holds a sheet may be provided for the pair of discharged-sheet supports 33 (or for the pair of the lowermost discharged-sheet supports 33*c*), and the timing may be determined based on a result of detection of the sensor. That is, the discharged-sheet supports 33 are stopped when the results of detection of all of the sensors have a value indicating that a sheet is not held.

In this embodiment, every time a sheet is printed, the processing shown in FIGS. 4(*a*) through 4(*e*) is repeated. However, some processes may be omitted for first three sheets or last three sheets. For example, when printing on a second sheet has been completed, it is only necessary to move the previously printed first sheet from the discharged-sheet support pair 33*a* onto the discharged-sheet support pair 33*b* by operating the discharged-sheet support pair 33*a*, and it is unnecessary to operate the discharged-sheet support pairs 33*b* and 33*c*. On the other hand, when moving a finally printed sheet onto the lower discharged-sheet supports 33, it is unnecessary to operate the discharged-sheet supports 33 above the discharged-sheet supports 33 holding the final sheet.

As described above, in the discharged-sheet stacking device of the present invention, a longer time period can be secured for drying ink without providing a waiting time period during printing or sheet discharging. Accordingly, in an image forming apparatus including such a discharged-sheet stacking device, it is possible to perform high-speed printing while preventing staining due to superposition and rubbing of sheets.

The individual components shown in outline or designated by blocks in the drawings are all well-known in the discharged-sheet stacking device and image forming apparatus arts and their specific construction and operation are not critical to the operation or the best mode for carrying out the invention.

While the present invention has been described with respect to what is presently considered to be the preferred embodiment, it is to be understood that the invention is not limited to the disclosed embodiment. To the contrary, the present invention is intended to cover various modifications and equivalent arrangements included within the spirit and scope of the appended claims.

What is claimed is:

1. A discharged-sheet stacking device for stacking sheets discharged from another device, said discharged-sheet stacking device comprising:

a plurality of holding units each with supports moveable between a closed holding position where a discharged sheet is held and an open releasing position where a held sheet is released, said holding units disposed vertically to one another;

holding-unit driving means for independently moving each of said holding units between the closed holding position and the open releasing position; and stacking control means for controlling movement of said holding units by said holding-unit driving means, to sequentially reposition sheets held in first one of said plurality of holding units to drop into a second one of said plurality of holding units which is lower than said first holding unit by moving the position of said first holding unit in a predetermined sequence.

2. An image forming apparatus comprising:

image forming means for forming an image on a sheet;

a discharged-sheet stacking device for stacking sheets discharged from another device, said discharged-sheet stacking device comprising:

a plurality of holding units each with supports moveable between a closed holding position where a discharged sheet is held and an open releasing position where a held sheet is released, said holding units disposed vertically to one another;

holding-unit driving means for independently moving each of said holding units between the closed holding position and the open releasing position; and stacking control means for controlling movement of said holding units by said holding-unit driving means, to sequentially reposition sheets held in first one of said plurality of holding units to drop into a second one of said plurality of holding units which is lower than said first holding unit by moving the position of said first holding unit in a predetermined sequence;

discharging means for discharging the sheet on which the image has been formed by said image forming apparatus toward a discharged-sheet stacking device; and main control means for controlling said discharged-sheet stacking device and said image forming means, wherein said main control means causes said stacking control means to continue the repositioning while a sheet is held in any one of said holding units even after the image formation by said image forming means has been completed.

3. An image forming apparatus according to claim 2, wherein said main control means calculates a number of sheets on which images have been formed by said image forming means and a frequency of executions of the repositioning processing, and based on results of the calculations determines whether or not a sheet is still held in any one of said holding units.

4. An image forming apparatus according to claim 3, wherein said image forming means forms an image by discharging ink onto a sheet.

5. A discharged-sheet stacking device comprising:

a plurality of holding units each with supports moveable between a closed holding position where a discharged sheet is held and an open releasing position where a held sheet is released, and in which sheets held in the holding position are disposed so as to be vertically superposed;

holding-unit driving means for independently shifting a state of said holding units between the holding position and the releasing position;

discharging means for discharging a sheet onto the uppermost of said holding units; and control means for controlling said holding-unit driving means so that every time a sheet is discharged by said discharging means, said holding units are sequentially shifted to the releasing position and are then returned to the holding position from the lowermost holding unit to the uppermost holding unit.

* * * * *

UNITED STATES PATENT AND TRADEMARK OFFICE

CERTIFICATE OF CORRECTION

PATENT NO. : 5,921,690

DATED : July 13, 1999

INVENTOR(S): MASAYA SHINMACHI, ET AL.

It is certified that error appears in the above-identified patent and that said Letters Patent is hereby corrected as shown below:

COLUMN 1:
Line 9, "evice" should read -device-.
COLUMN 2:
Line 14, "anda" should read -and a-.
COLUMN 3:
Line 57, "are" should read -is-; and
Line 61, "are" should read -is-.
COLUMN 6:
Line 57, "jub" should read -job-.

Signed and Sealed this

Seventh Day of March, 2000

*Attest:*

*Attesting Officer*

Q. TODD DICKINSON

*Commissioner of Patents and Trademarks*